US007743451B2

(12) United States Patent
Kim

(10) Patent No.: US 7,743,451 B2
(45) Date of Patent: Jun. 29, 2010

(54) SANITARY CLEANING DEVICE WITH DISPOSABLE CLEANING HEAD

(76) Inventor: Seok-Jin Kim, 11855 Somerset Way South, Carmel, IN (US) 46033

( * ) Notice: Subject to any disclaimer, the term of this patent is extended or adjusted under 35 U.S.C. 154(b) by 0 days.

(21) Appl. No.: 10/454,122

(22) Filed: Jun. 4, 2003

(65) Prior Publication Data

US 2004/0244130 A1 Dec. 9, 2004

(51) Int. Cl.
*A47L 11/10* (2006.01)

(52) U.S. Cl. ..... 15/145; 15/104.94; 15/244.1; 15/160; 15/210.1; 15/176.1; 15/176.6; 403/213; 16/422; 4/255.11

(58) Field of Classification Search ..... 15/244.1, 15/244.2, 209.1, 210.1, 220.1, 143.1, 144.1, 15/154, 145, 104.93, 176.1, 176.5, 104.94; 4/255.11; 403/213, 215, 289, 290, 329; 16/422
See application file for complete search history.

(56) References Cited

U.S. PATENT DOCUMENTS 613,683 A * 11/1898 Kemp ..... 15/233
856,733 A * 6/1907 Saffold ..... 15/209.1
1,679,392 A * 8/1928 Applin ..... 15/229.13
1,692,110 A * 11/1928 Cave et al. ..... 403/212
1,898,698 A * 2/1933 Trompeter ..... 15/154
2,658,222 A * 11/1953 Mackert ..... 15/245
2,867,832 A * 1/1959 Hanninen ..... 15/244.2
3,131,409 A * 5/1964 Davis ..... 15/244.1
3,474,480 A * 10/1969 Young ..... 15/114
3,753,267 A * 8/1973 Johnson, Sr. ..... 15/210.1
3,892,005 A * 7/1975 Berns ..... 15/245
4,031,673 A 6/1977 Hagelberg
4,075,033 A 2/1978 Knox et al.
4,110,870 A * 9/1978 Weihrauch ..... 16/422
4,169,297 A * 10/1979 Weihrauch ..... 15/145
4,237,573 A * 12/1980 Weihrauch ..... 15/145
4,457,038 A 7/1984 Hammond
4,475,836 A * 10/1984 Colognori ..... 401/201
4,483,356 A * 11/1984 Kales ..... 132/320

(Continued)

FOREIGN PATENT DOCUMENTS

EP 1 183 980 A2 3/2002

*Primary Examiner*—Gary K Graham
(74) *Attorney, Agent, or Firm*—Woodard, Emhardt, Moriarty, McNett & Henry LLP

(57) ABSTRACT

Described are preferred sanitary cleaning devices that include a disposable cleaning head portion and a handle portion. The cleaning head is releasably connectable to the handle portion. The handle portion includes a pair of elongate rods laterally spaced relative to one another and capable of deflection toward one another. The rods present prongs that are selectively received within and removed from apertures provided in the cleaning head. To attach the cleaning head to the handle, the rods are deflected, for example by compressing a grip area, and the prongs are positioned adjacent the receiving apertures, and thereafter the rods are released. This causes the prongs to be received within the apertures, to connect the cleaning head to the handle. Preferred devices of the invention are advantageous in that the user need not touch the cleaning head or adjacent areas expected to contact materials from the toilet to achieve connection and removal of the head from the handle. Preferred devices also incorporate handle and attachment features with relatively smooth surfaces, minimizing their capacity to become soiled. In this fashion, more sanitary cleaning operations and storage features are provided.

18 Claims, 13 Drawing Sheets

U.S. PATENT DOCUMENTS 4,493,124 A * 1/1985 Agapiou ..... 15/104.94
4,601,081 A 7/1986 Sutton et al.
4,754,516 A * 7/1988 Tremblay ..... 15/176.6
4,852,201 A 8/1989 Wundrock et al.
5,025,524 A 6/1991 Genovese, Jr.
5,067,194 A 11/1991 Rosenfeld et al.
5,092,013 A 3/1992 Genovese, Jr.
5,094,559 A 3/1992 Rivera et al.
5,803,646 A * 9/1998 Weihrauch ..... 403/290
7,386,913 B2 * 6/2008 Jackson ..... 15/176.6

* cited by examiner 26
48
49
50
51
52
53
54
55
56
57
58

SANITARY CLEANING DEVICE WITH DISPOSABLE CLEANING HEAD

BACKGROUND OF THE INVENTION

The present invention relates generally to cleaning devices, and in one particular aspect, to a cleaning device having a disposable head and which is useful for cleaning toilet bowls or the like.

As further background, a number of devices are known to facilitate cleaning toilet bowls and other relatively unsanitary areas. Conventional toilet bowl brushes are made of a plastic brush, and a handle permanently secured thereto. After use of the brush, it is typically rinsed within the toilet and stored for later use. This practice can be relatively unsanitary since the brush can harbor germs and oftentimes retain an undesirable odor. This is also true of conventional storage compartments for such brushes which often become similarly fouled.

Some efforts have been made in the past to develop toilet cleaning devices that are more convenient to use. For example, U.S. Pat. No. 5,094,559 describes a cleaning device having a cleaning pad with a scrubbing layer on one side and a blotting layer on the other. The cleaning pad is inverted between scrubbing and blotting positions in a rotational operation. The cleaning pad can include packets of cleaning solution contained therein which can be ruptured to release a cleaning agent.

U.S. Pat. No. 5,092,013 describes a disposable toilet seat wipe apparatus that has a premoistened cleansing pad coupled to a plunger extending outwardly from a carrying container for the cleansing pad. The cleansing pad "blossoms" outwardly from the end of the container.

U.S. Pat. No. 5,025,524 discloses another toilet seat wiping apparatus in which a cleansing pad blossoms out over the end of a rod about which it is originally folded and compressed.

U.S. Pat. No. 5,067,194 describes a cleaning device having a shaft and a wiper member at the end of the shaft. A pocket-shaped disposable wiper is received on the wiper member. The disposable wiper is fabricated of paper or paper-like material and is flushed away after cleaning.

U.S. Pat. No. 4,852,201 describes a toilet bowl cleaner including a packet containing a cleaning composition and a holder for the packet. The packet attaches to the holder through a pocket on the packet which is slidable over a tongue member of the holder so that the outer flap of the pocket can be clamped to the holder through a lock mechanism. The lock mechanism includes a snap lock having a pair of spaced apart resilient fingers which cooperate with the leading edge of the head portion of the holder to provide a snap fit.

U.S. Pat. No. 4,601,081 discloses a disposable utensil for cleaning toilet seats that includes an absorbent pad mounted on a handle. The pad is impregnated with a cleaning agent, and the overall unit is packaged in an air-tight covering. This covering is removed, the device used, and then disposed of in its entirety.

U.S. Pat. No. 4,457,038 discloses a permanent handle for disposable brush or mop head. The engagement between the handle and the head is frictional between a cylindrical member on the head and the cylindrical handle. An internal plunger is present in the handle and can be actuated to dislodge the mop head from the handle during a disposal operation.

U.S. Pat. No. 4,075,033 discloses a cup-shaped cleaning web attached to an elongated handle having a compressible sponge attached to the end of the handle. The sponge is forced into the cup-shaped web under compression, which holds it in place. A plunger internal to the handle can be actuated to dislodge the web from the sponge for disposal after cleaning.

U.S. Pat. No. 4,031,673 describes a cleaning device for toilet bowls that has a disposable pad containing a cleaning compound. The pad is attached to the end of a holder that has a spade-shaped end that is bifurcated and thus in its relaxed position presents an opening. The pad is clamped in this opening as the plunger handle is drawn upwardly thus causing the bifurcated spade portion to compress, and clamp an upper surface of the pad.

EP 1183980A2 discloses a toilet brush having a hollow cylindrical body and a disposable brush. The brush has grooves that cooperate with stems that can be displaced horizontally by depressing pushbuttons on the side of the body to provide an attach/detach function.

Despite these prior efforts to develop improved cleaning devices useful for cleaning toilet areas, the remains a need for cleaning devices having better sanitary operation, relatively simple design, and less potential to retain undesired germs or odor. The present invention is addressed to these needs.

SUMMARY OF THE INVENTION

In one aspect, the present invention provides a sanitary cleaning device for a toilet that includes a disposable head, and a handle portion to which the disposable head can be releasably attached. The handle portion includes two elongate rods spaced from another and each terminating in a retention member, wherein the rods can be manipulated at a location spaced from the retention members to alter the position of the retention members relative to one another. The disposable head includes openings for receiving the retention members and retaining connection of the head to the handle portion when the retention members are in a first position relative to one another, and for releasing the connection between the head and handle portion when the retention members are in a second position relative to one another.

Illustratively, in one preferred embodiment, the retention members are prongs which are laterally spaced a first distance when the elongate rods are in their relaxed condition, and laterally spaced a second distance when the elongate rods are in a compressed condition. Thereby, the elongate rods can be deflected, the prongs can be positioned next to the receiving openings in the disposable head, and the elongate rods released to their relaxed condition to connect the disposable head to the handle portion. After the cleaning operation is complete, the elongate rods can be again deflected to release the disposable head from the handle portion, whereby the disposable head can be disposed of.

In another embodiment, the present invention provides a non-disposable handle for use with a toilet cleaning or servicing device having a disposable head. The handle includes a proximal grip, and a pair of elongate rods having ends received within the grip. Retaining members are provided at distal portions of the elongate rods, and are configured to cooperate with adaptations in a disposable head to releasably attach the head to the handle.

In another embodiment, the invention provides a disposable head for use in a toilet cleaning device in conjunction with a handle portion having two elongate rods. The disposable head includes a cleaning element, typically an absorbent cleaning element, and a support for the cleaning element. The support includes adaptation for cooperation with retention members on the rods to achieve a releasable connection between the disposable head and handle portion.

The present invention provides improved sanitary devices for use to clean toilet areas such as toilet bowls. Preferred devices of the invention are also relatively simple in design, and present minimal surface edges that could trap and retain germs or other fouling agents, and which do not require the user to touch the disposable cleaning head or areas of the device that typically come into contact with materials from the area being cleaned. Preferred devices of the invention also provide cleaning agents incorporated into a cleaning head, thus eliminating the need to buy separate cleaning agents.

Additional preferred embodiments as well as features and advantages of the invention will be apparent from the descriptions herein.

BRIEF DESCRIPTION OF THE DRAWINGS

FIG. 7 provides a bottom view of the inner chamber member of the device depicted in FIGS. 6A-6D.

DESCRIPTION OF THE PREFERRED EMBODIMENT

Figure 1:
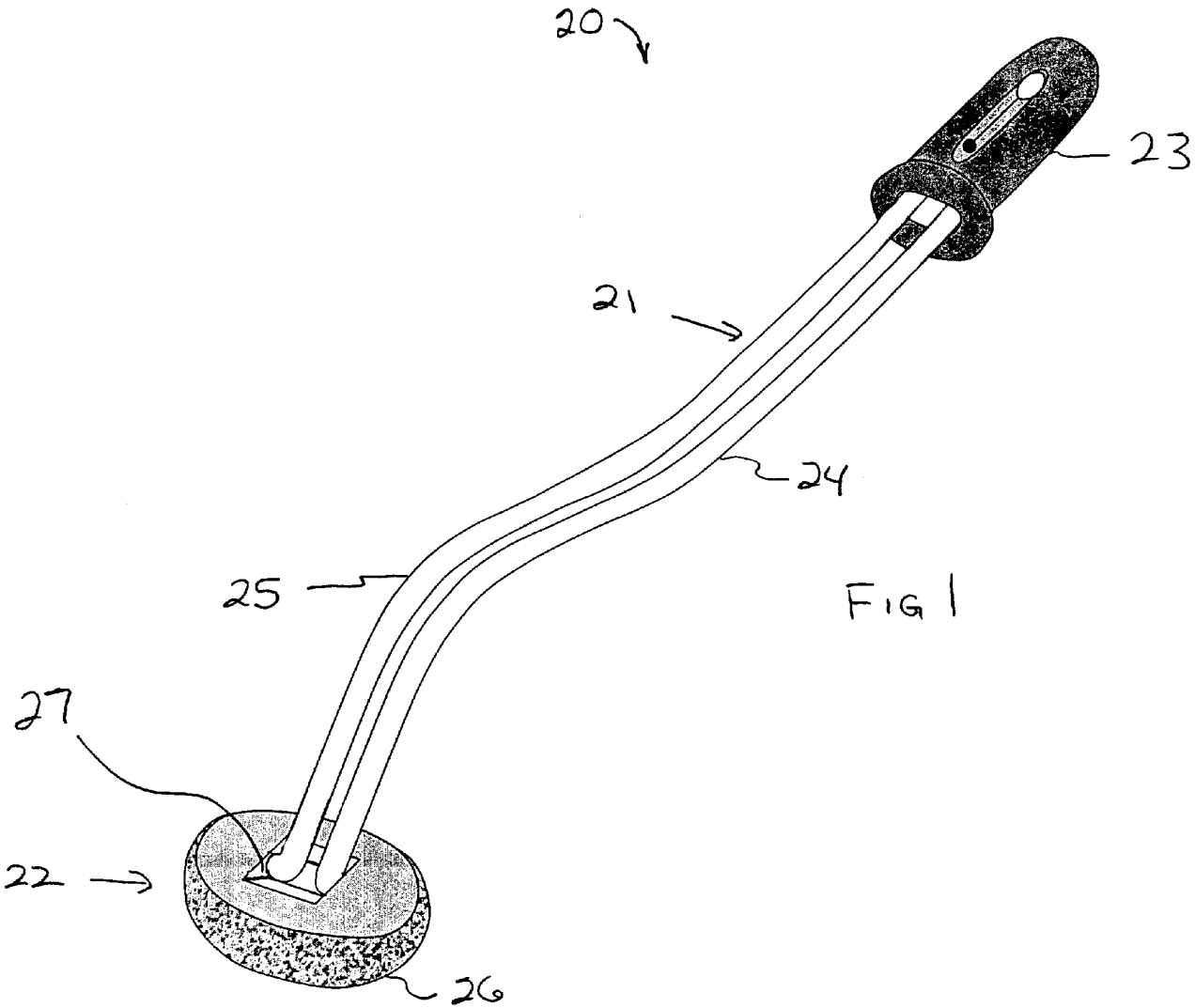
FIG. 1 provides a perspective view of a preferred sanitary disposable cleaning device of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

As disclosed above, the present invention provides sanitary cleaning devices having disposable portions, as well as handles and disposable heads useful in such devices.

Referring now to FIG. 1, shown is a sanitary cleaning device 20 of the present invention. Cleaning device 20 generally includes a handle portion 21, and a disposable cleaning head 22. Handle portion 21 includes a grip 23, and two (i.e., at least two) elongate rods 24 and 25 connected to the grip 23. Additional rods could be provided if desired to achieve additional contact or connection with the cleaning head 22, or for other purposes. Cleaning head 22 includes a scrubbing surface 26, and a receiving portion 27 for receipt of elements of the handle portion 21 to achieve a releasable connection.

Figure 2:
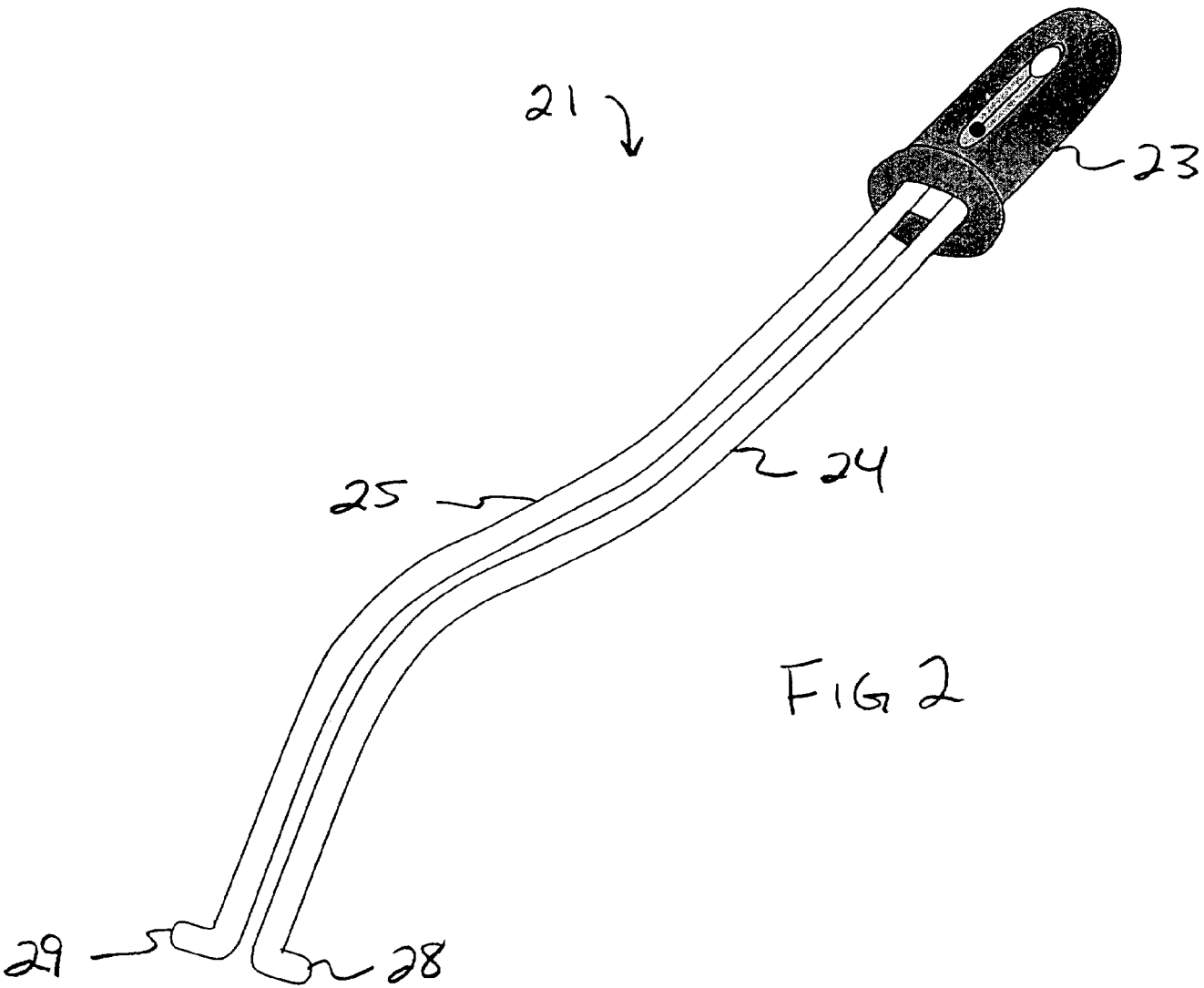
FIG. 2 provides a perspective view of the handle portion of the device of FIG. 1.

With reference now to FIG. 2, shown is a perspective view of the handle portion of the device depicted in FIG. 1. Handle portion 21, as discussed above, includes a grip 23 and pair of elongate rods 24 and 25 connected thereto. Elongate rods 24 and 25 terminate in retention members 28 and 29, which in the illustrated device are provided by prongs extending transversely to the axial direction of elongate members 24 and 25. Particularly in the illustrated handle portion 21, prongs 28 and 29 extend generally perpendicularly relative to the axis of elongate members 24 and 25. In accordance with the invention, the elongate members 24 and 25, grip 23, and retention members 28 and 29 are arranged whereby elongate members 24 and 25 can be deflected (e.g. compressed) at an upper portion thereof, for example within or approximate to the grip 23, to reduce the lateral spacing between elongate members 24 and 25, thereby bringing retention members 28 and 29 closer to one another. In this fashion, a releasable connection can be made with a disposable cleaning head having appropriate portions for cooperating with the retention members 28 and 29. It will also be understood that retention members 28 and 29 could include openings, indentations or other features instead of prongs, with corresponding cooperating elements (e.g. prongs cooperative with the openings or indentations) positioned on the cleaning head 22.

Figure 3A:
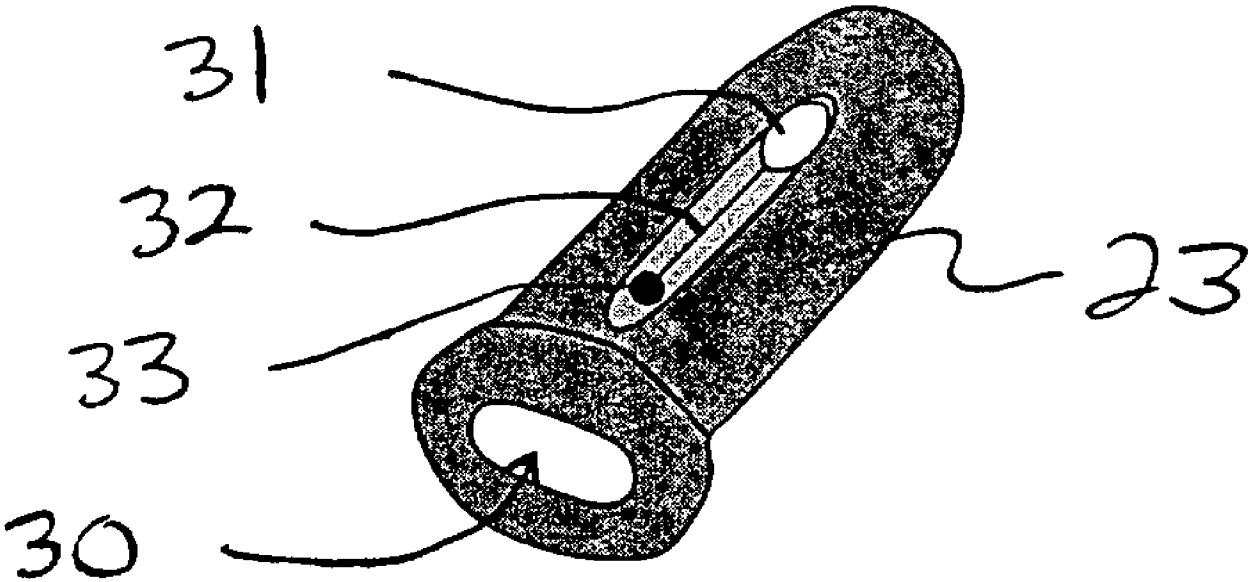
FIG. 3 provides a perspective view of the handgrip of the handle depicted in FIG. 2.
FIG. 3B provides an enlarged top view of the grip of FIG. 3A.
FIG. 3C provides a cross-sectional view of the grip depicted in FIG. 3B taken along line C-C and viewed in the direction of the arrows.
FIG. 3D provides a top view of the grip depicted in FIG. 3B having a button thereof depressed and moved partially longitudinally along the provided slot.
FIG. 3E provides a cross-sectional view taken along line E-E of FIG. 3D and viewed in the direction of the arrows.
FIG. 3F provides a cross-sectional view taken along line F-F of FIG. 3E and viewed in the direction of the arrows.

With reference now to FIG. 3A, shown is a perspective view of the grip 23 of the handle portion 21 depicted in FIG. 2. Grip 23 includes an opening 30 for receiving proximal ends of elongate members 24 and 25. Grip member 23 also includes a depressible button 31 located on an upper surface thereof, a groove 32 along which button 31 and elements cooperable therewith can travel, and a terminal opening 33B for establishing a forward-locked position of button 31 and elements cooperable therewith.

Figure 3C:
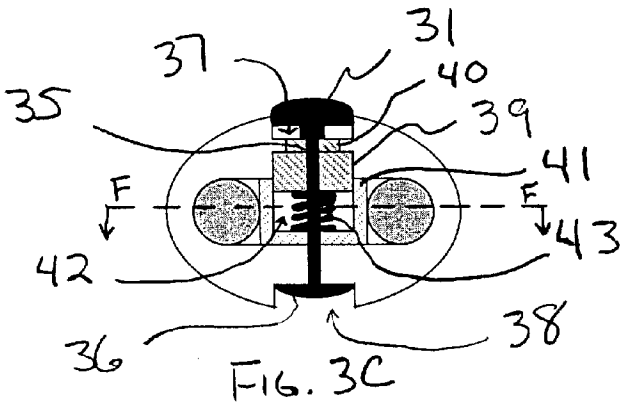
Figure 3B:
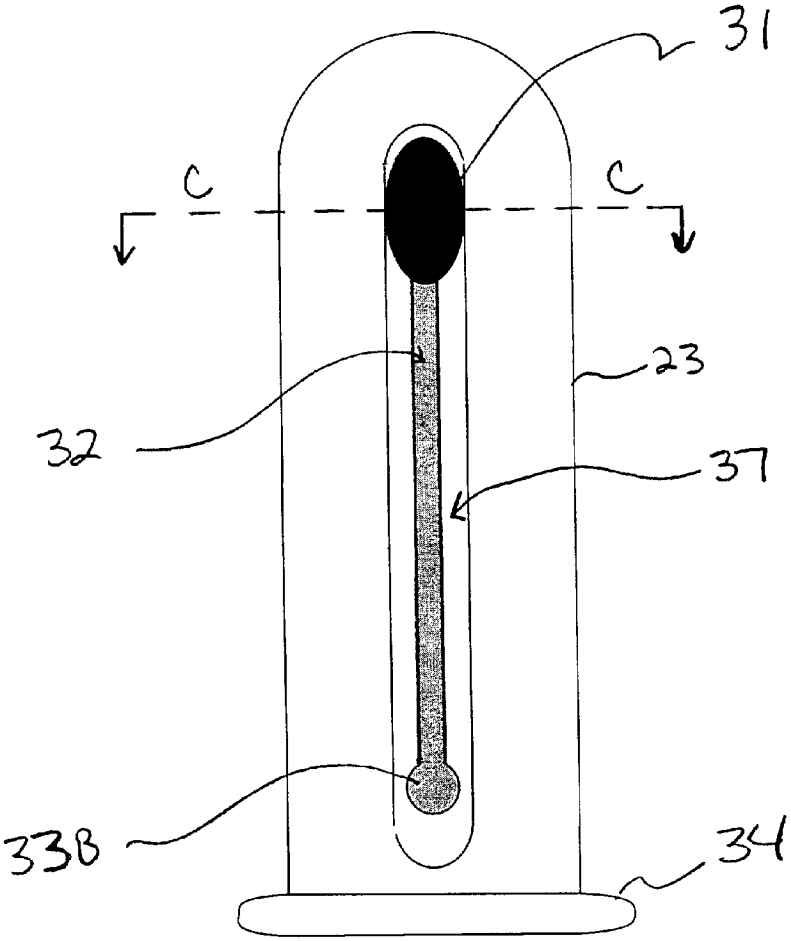

Turning now to FIG. 3B, shown is an enlarged top view of the grip depicted in FIG. 3A. Grip 23 includes button 31, groove 32, and terminal opening 33B as discussed above. Grip 23 also includes a shoulder 34 that helps to prevent the hand of a user from sliding forwardly off of grip 23.

FIG. 3C provides a cross-sectional view taken along lines C-C of FIG. 3B and viewed in the direction of the arrows. FIG. 3C thereby shows internal components of grip 23. In particular, button 31 is cooperable with several elements received within grip 23. In this regard, a rod 35 is attached to button 32 and extends through a number of other elements to be described below, terminating in an underlying stop element 36. Button 31 and stop element 36 reside within an upper groove 37 and a lower groove 38 defined in the grip housing, and are slidable therealong. A first wedge piece 39 and a second wedge piece 40 are fixedly attached to rod 35.

First piece 39 has a cross-sectional dimension greater than that of second piece 40. Alternatively, first piece 39 and second piece 40 can be provided in an integral unit attached to rod 35. The cross-sectional dimension of first piece 39 corresponds to the internal dimension of a third wedge piece 41, whereby first piece 39 can be received within third wedge piece 41. Wedge piece 41 defines an internal chamber 42. Within internal chamber 42 is provided spring 43, for biasing wedge piece 39, wedge piece 40 and button 31 upwardly.

Figure 3E:
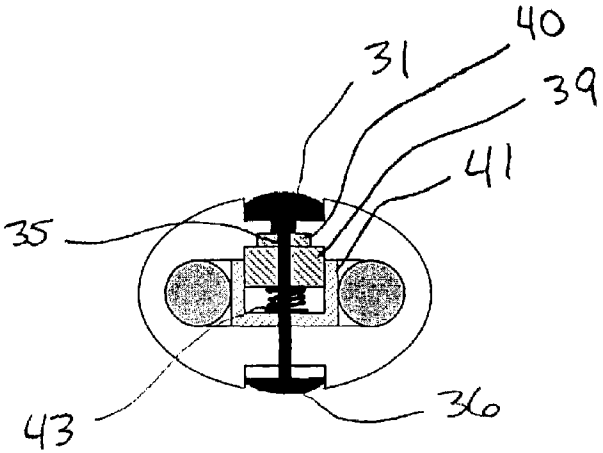
Figure 3D:
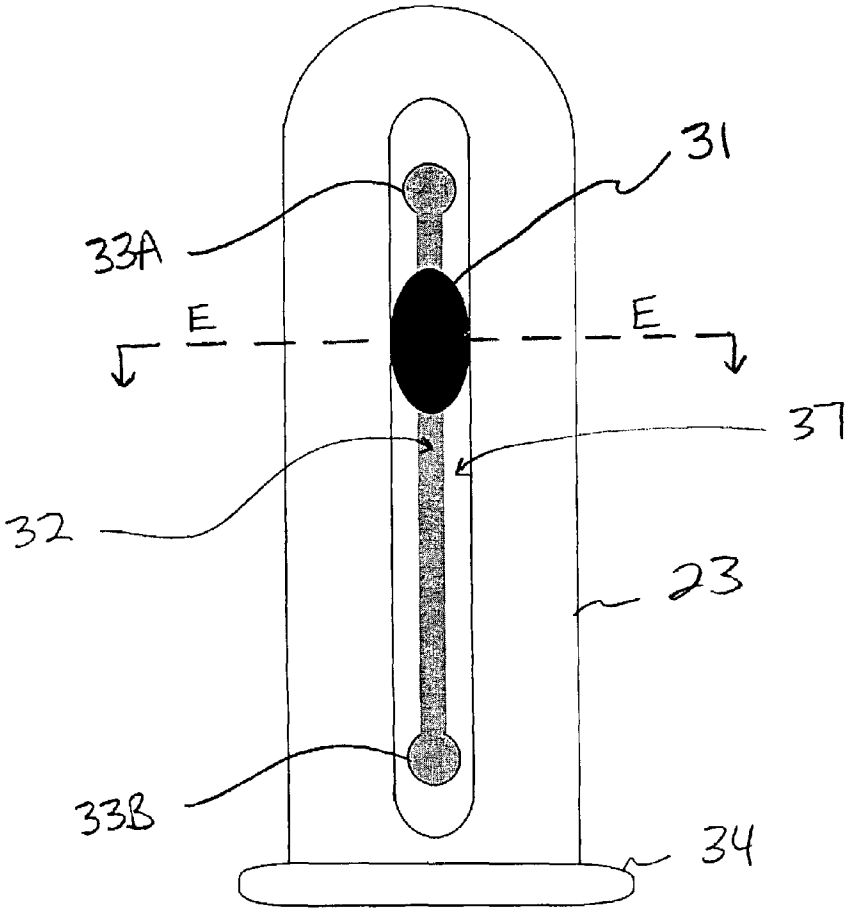

With reference now to FIG. 3D, shown is a top view of the grip depicted in FIG. 3B, except having button 31 depressed and moved partially along groove 32. Similarly, FIG. 3E provides a cross-sectional view of the grip depicted in FIG. 3D taken along line E-E and viewed in the direction of the arrows.

With reference now to FIGS. 3A through 3E taken together, the function of the grip 23 and its movable elements will be described further. Generally speaking, grip 23 in combination with its movable elements provides a wedge positioned between elongate members 24 and 25 (see e.g., FIGS. 1 and 2) which can be moved to first and second locked or otherwise stationary positions longitudinally along elongate members 24 and 25. In a first more proximal (or "rearward") position, wedge is positioned generally behind the hand of a user positioned on the grip, whereby the grip can be compressed by the hand, to thereby deflect the elongate members 24 and 25 toward one another, during an insertion or release operation between the handle portion 21 and the disposable cleaning head 22. In particular, FIGS. 3B and 3C show the button 31 and its internal cooperating elements in a proximal or rearward position thereby allowing the user to deflect the elongate members 24 and 25 by compressing the grip 23 during a release or insertion operation. After handle portion 21 is inserted into cleaning head 22, compression is removed from grip 23, thereby achieving a connection between the handle portion 21 and the cleaning head 22. Button 31 is then depressed, thereby overcoming the bias of spring 43 and driving the first wedge piece 39 and second wedge piece 40 downwardly into the chamber 42 defined by third wedge piece 41. This drives second wedge piece 40 out of its position received within corresponding opening 33A, thus permitting the longitudinal movement of the button 31 and connected elements along the groove 32, as generally depicted in FIGS. 3D and 3E. The longitudinal movement of the button 31 and its cooperating elements is continued until these components reach opening 33B located at the distal end of groove 32. Release of the button 31 allows the upward bias provided by spring 43 to drive the first wedge piece 39 and second wedge piece 40 upwardly, thereby causing the receipt of second wedge piece 40 within opening 33B and locking the button 31 and cooperating elements in the distal or forward position. In this position, the hand of the user upon the grip 23 is located generally behind the wedging elements, and thus compression forces exerted on the grip 23 during a cleaning operation will not be translated to the retention members 28 and 29 located at the distal end of the elongate members 24 and 25 (see FIGS. 1 and 2). In this manner, the cleaning operation can be conducted without concern for unintentionally releasing cleaning head 22 from handle portion 21. In addition, the position of the wedge elements between the elongate members 24 and 25 increases the level of force needed to laterally displace member 24 and/or 25 through contact at or near cleaning head 22. This can serve to reduce the chance of accidental release of cleaning head 22 when the lateral or side portion of cleaning head 22 is used for a cleaning operation so as to potentially cause lateral contact of elongate member 24 and/or 25 with portions of the toilet bowl, for example.

Figure 3F:
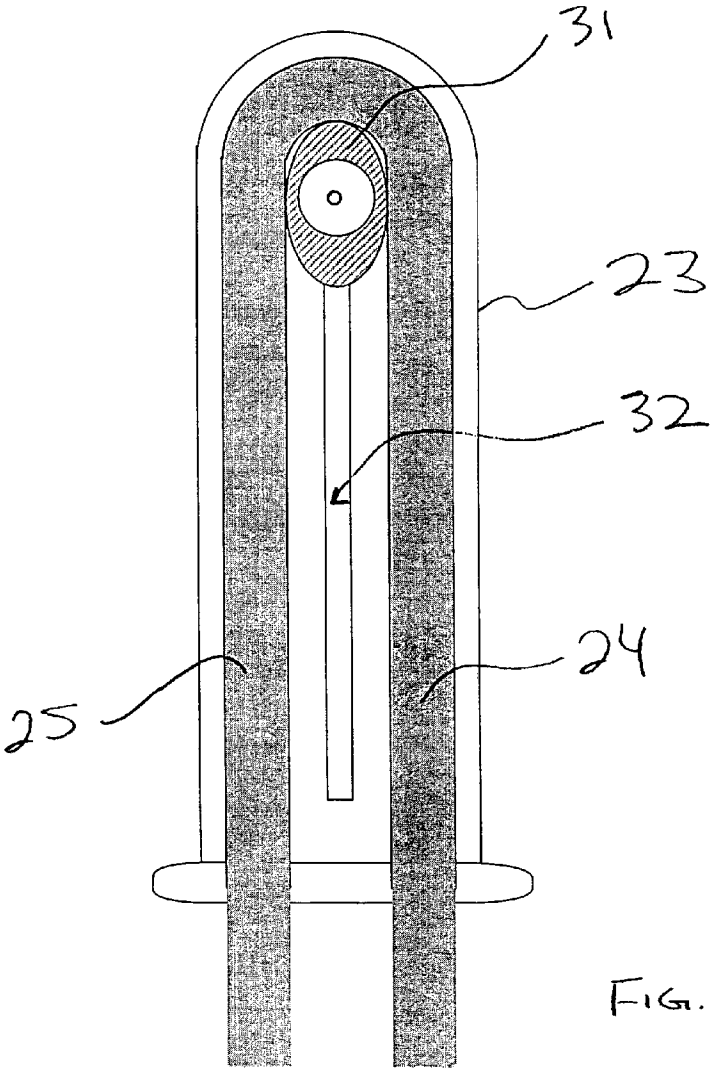

With reference to FIG. 3F, shown is a cross-sectional view taken along line F-F of FIG. 3C and viewed in the direction of the arrows. In addition, FIG. 3F shows the proximal end of the elongate rod element received within the grip 23.

Figure 4:
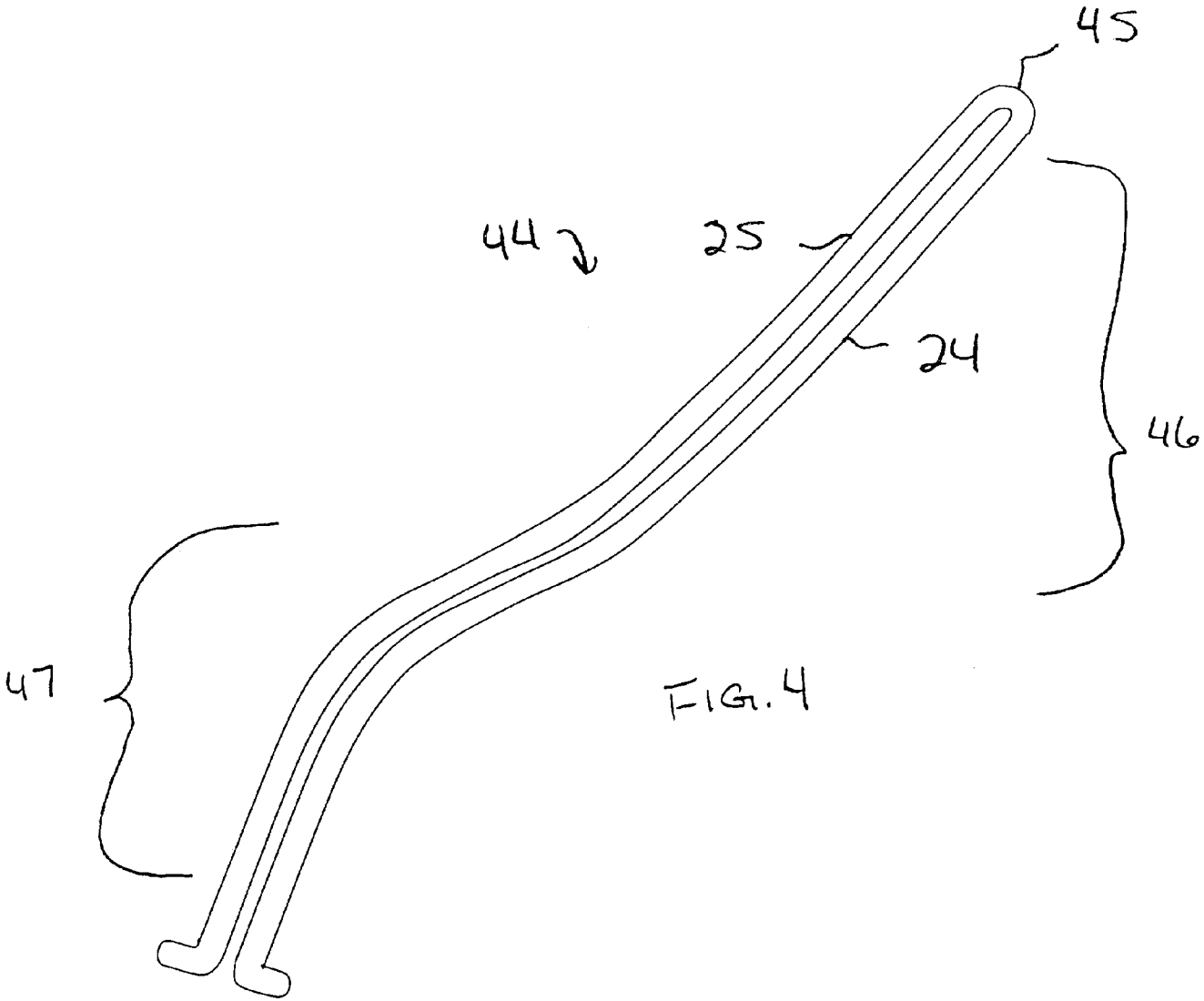
FIG. 4 provides a perspective view of the elongate rod element of the handle portion depicted in FIG. 2.

With reference now to FIG. 4 shown is a perspective view of an elongate rod element 44 providing elongate rods 24 and 25. In particular, the illustrated element 44 is an integral unit including a bend portion 45 occurring between rods 24 and 25. Bend 45 provides a stable spacing of rods 24 an 25, and a spring function in that the compression along rods 24 and 25 will overcome the spacing provided by bend 45 and cause the rods 24 and 25 to move to closer to one another. Elongate rod element 44 has a first portion 46 in which the elongate rods 24 and 25 are generally straight, and a second portion 47 wherein the elongate rods 24 and 25 adopt a curved configuration. This design improves the ergonomic character of the rods 24 and 25, and allows the user to more effectively scrub hard-to-reach surfaces by inverting handle portion 21 to provide an upwardly-facing orientation to the attached cleaning head 22.

Figure 5:
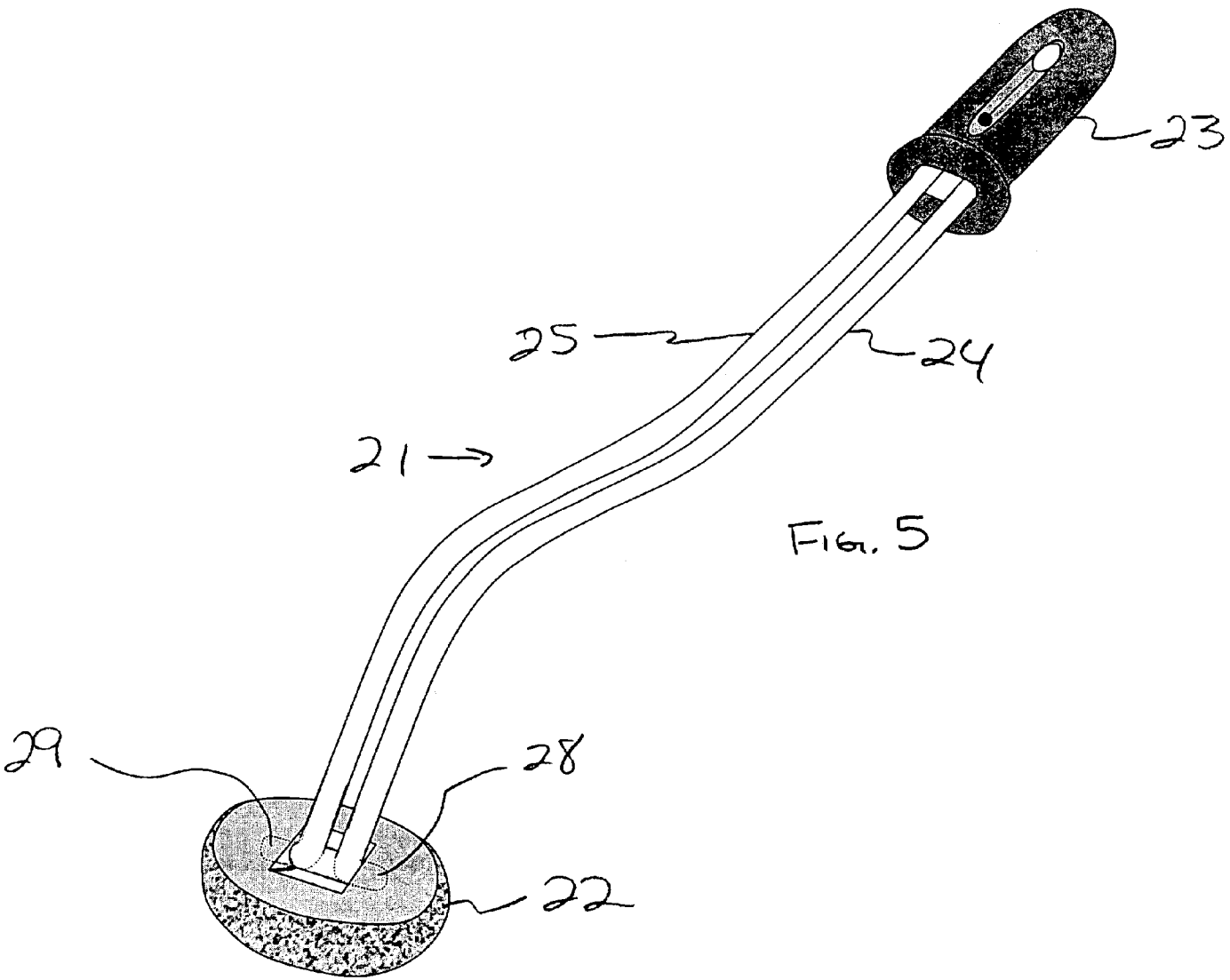
FIG. 5 provides a perspective view of the cleaning device of the present invention showing in phantom the receipt of prongs of the handle portion into receiving openings of the cleaning head.

With reference now to FIG. 5, shown is a perspective view of the cleaning device of the present invention, illustrating in phantom the retention members 28 and 29 of the handle portion 21 received within the cleaning head 22. With continued reference to FIG. 5 and also to FIG. 6A, the cleaning head 22 will now be described in more detail. As noted above, cleaning head 22 includes a cleaning surface 26 and a portion 27 for receiving and connecting to elements of handle portion 21. Receiving portion 27 generally includes a first receiving aperture 48 and a second receiving aperture 49 for receiving the retention member 28 and 29 of the handle portion 21. Receiving portion 27 also includes walls 50 and 51 which are desirably at an angle is less than 90 degrees relative to the upper surface of cleaning head 22. In this fashion, walls 50 and 51 provide a generally beveled configuration which allows a range of motion for the cleaning head 22 to rock when attached to the handle portion 21, where a rotational cooperation is provided between retention members 28 and 29 and receiving apertures 48 and 49. Particularly, beveled walls 50 and 51 can be provided so as to allow, for example, a 90 degree rocking rotation of cleaning head 22 relative to handle portion 21, with contact between rods 24 and 25 and walls 50 and 51 providing the stops.

Figure 6A:
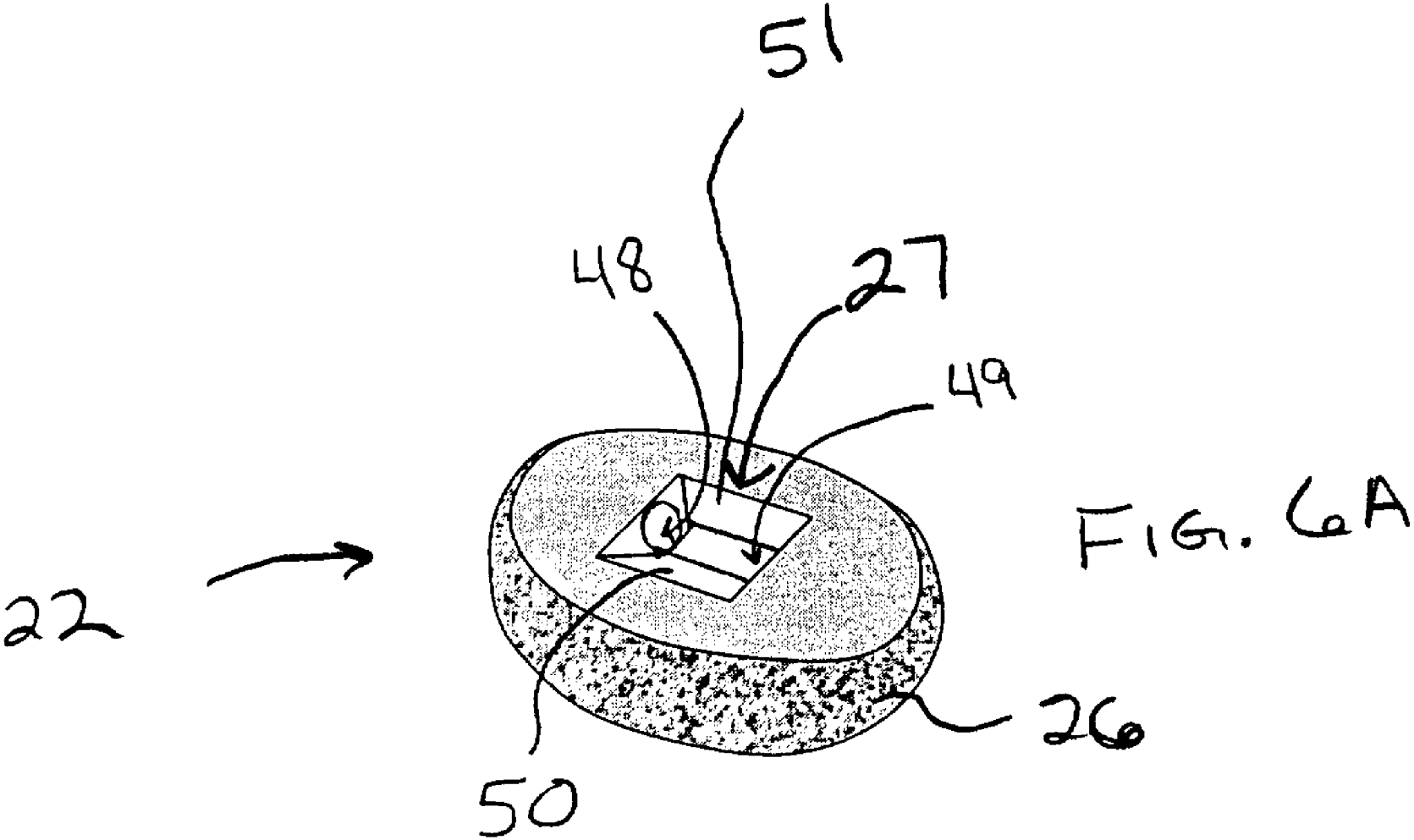
FIG. 6A provides a perspective view of the cleaning head of the device depicted in FIG. 1.
Figures 6B, 6C, 6D:
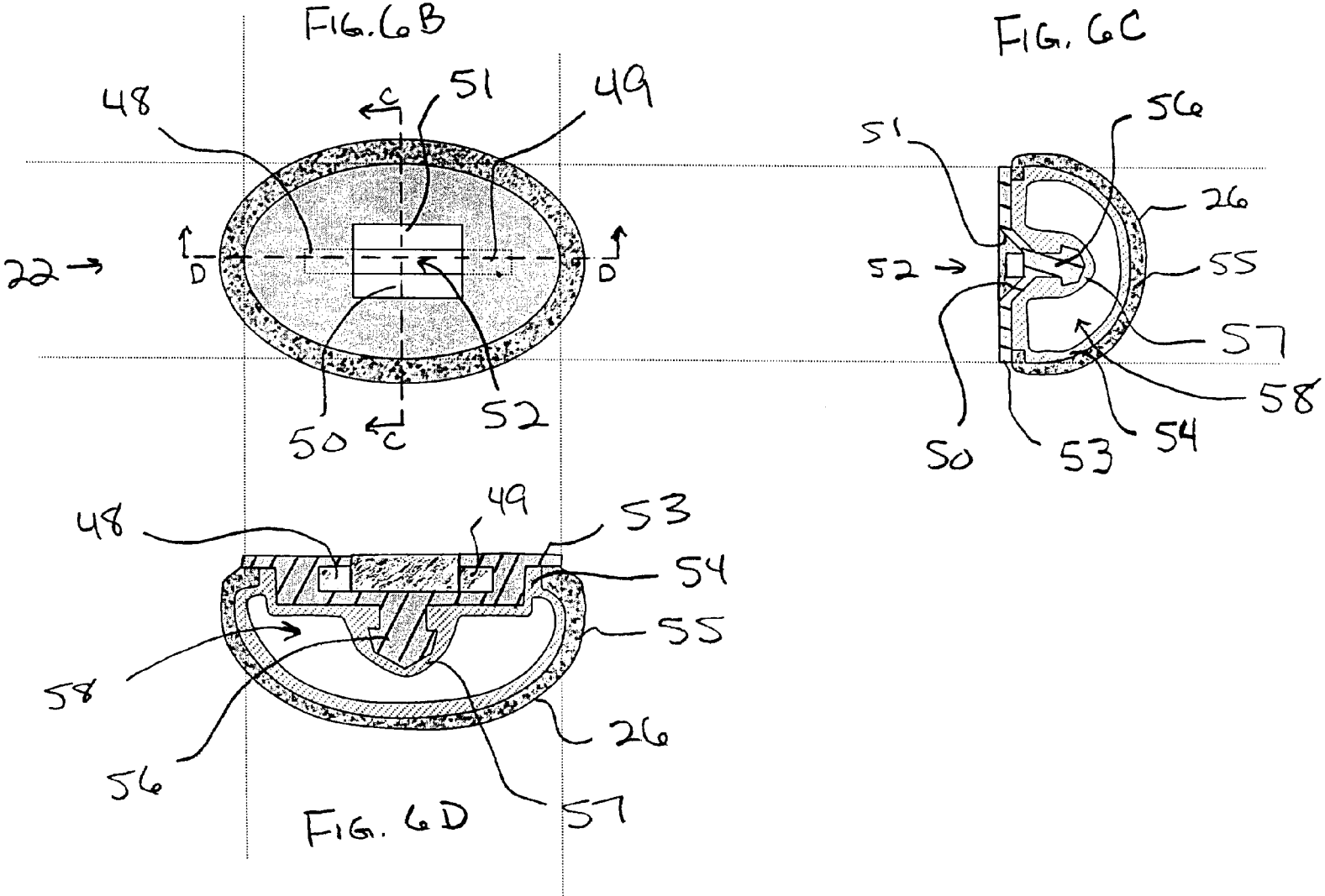
FIG. 6B provides a top view of the cleaning head depicted in FIG. 6A.
FIG. 6C provides a cross-sectional view of the cleaning head of FIG. 6B taken along line C-C and viewed in the direction of the arrows.
FIG. 6D provides a cross-sectional view of the cleaning head depicted in FIG. 6C taken along the line D-D and viewed in the direction of the arrows.
Figure 11:
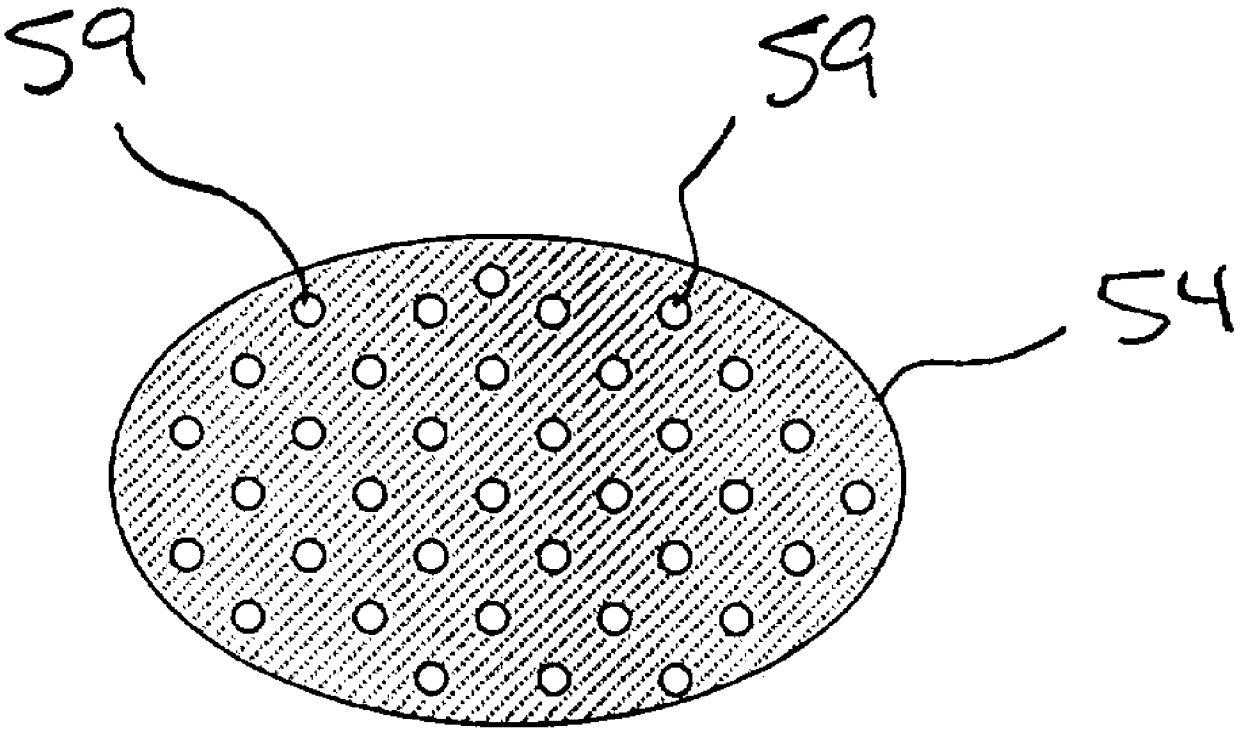

FIG. 6B provides a top view of the cleaning head 22 of FIG. 6A. FIG. 6C provides a cross-sectional view of the cleaning head of FIG. 6B taken along line C-C and viewed in the direction of the arrows. FIG. 6D provides a cross-sectional view of the cleaning head of FIG. 6B taken along line D-D and viewed in the direction of the arrows. Additional features of the cleaning head 22 will now be described with reference to these three Figures together. Cleaning head 22 presents a groove or slot 52 for receipt of the retention members 28 and 29 with the elongate rods 24 and 25 in their deflected configuration. Release of the deflection force on the rods thereafter allows retention members 28 and 29 to move outwardly with respect to one another and be received within apertures 48 and 49 to provide a connection between the cleaning head 22 and the handle portion 21. Cleaning head 22 is generally formed from 3 components, including a relatively rigid upper component 53 connected to a relatively resilient central component 54, which in turn is attached to a bottom component 55 which provides cleaning surface 26. Rigid component 53 includes a barb 56 or similar element for snap-fitting or friction-fitting to a corresponding member 57 of the resilient central component 54. Resilient central component 54 defines an inner chamber 58 in which cleaning agents or other useful substances may be contained or provided at the time of manufacture. These components may be liquid or solid materials received within chamber 58.

With reference now to FIG. 7, shown is a bottom view of resilient component 54 illustrating a number of apertures 59 provided therein for passage or release of cleaning or other agents received within chamber 58, and also allowing for passage of water or other fluids into chamber 58 during a submerged cleaning operation in order to activate or release the cleaning or other agents when desired.

Figure 8:
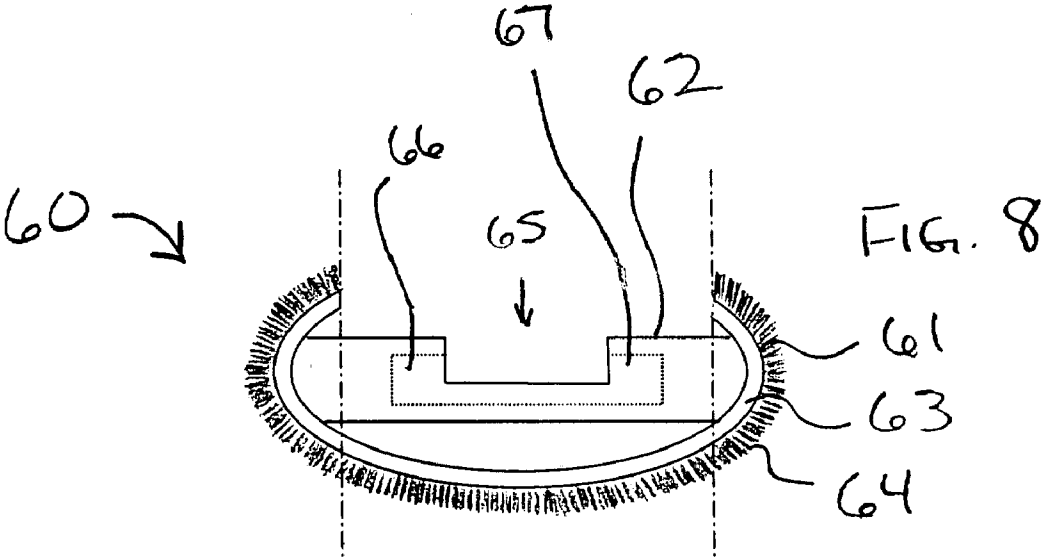
FIG. 8 provides a cross-sectional view of another disposable cleaning head for use in a cleaning device of the invention.
Figure 9:
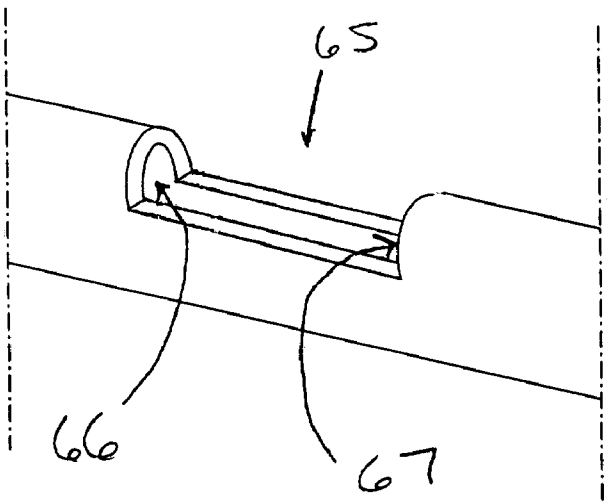
FIG. 9 is a cut-away perspective view of a central attachment element of the cleaning depicted in FIG. 8.

With reference now to FIGS. 8 and 9 together, shown is an alternative cleaning head 60 that can be used with handle portion 21 as described hereinabove. Cleaning head 60 can likewise be disposable, and generally includes a scrubbing surface 61 and an attachment element 62 for cooperation with handle member 21. Scrubbing surface 61 can for example be provided by an internal member 63, which can optionally be resilient in nature, and an external layer 64 attached thereto and containing bristles, absorbent scrubbing material, or other useful cleansing features. Attachment element 62 presents a receiving slot 65 for receiving retention members 28 and 29 when elongate rods 24 and 25 are in their deflected (unreleased) configuration, and apertures 66 and 67 for receiving such retention members when the deflection force on rods 24 and 25 is removed. Compared to cleaning head 22, cleaning head 60 is relatively simple in design, incorporating a generally centrally located attachment member 62, and a two-layer scrubbing element 61 connected thereto.

Figure 10:
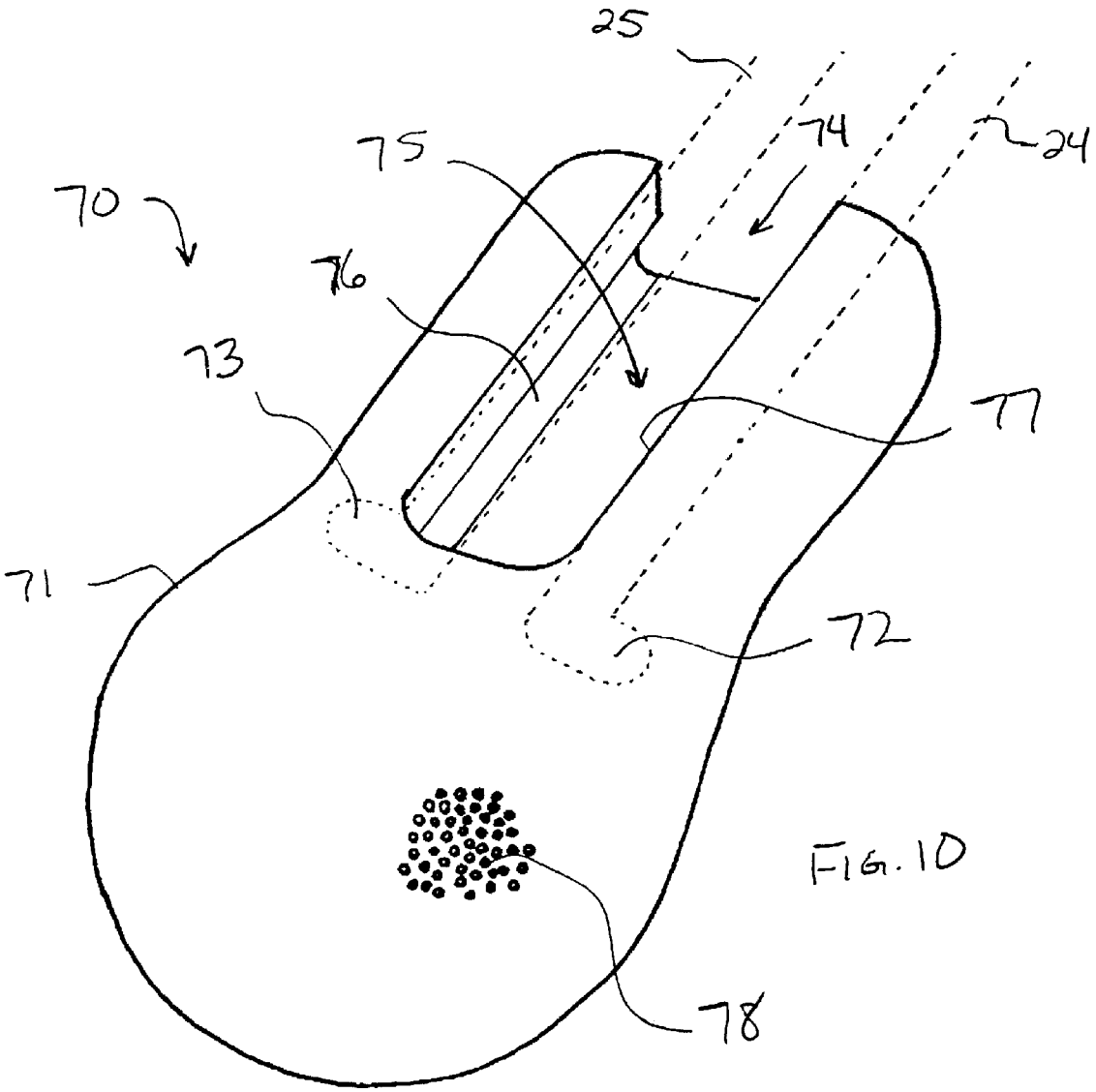
FIG. 10 provides a perspective view of another alternative disposable cleaning head for use with cleaning devices of the invention.

Turning now to FIG. 10, shown is another alternative cleaning head 70, preferably disposable, for use in connection with handle portion 21. Cleaning head 70 includes a cleaning surface 71 and provides apertures 72 and 73 for receipt of the retention members 28 and 29 of handle portion 21 (see FIG. 2). Cleaning head 70 is simple in design and can be formed primarily or completely from a single porous material such as sponge to provide cleaning surface 71. Alternatively, cleaning head 70 can be formed from a hollow plastic article, optionally also including bristles or other roughened surface features for scrubbing. Still further, cleaning head 70 can be formed from a cellulose-containing substance such as paper or paper-like material, for example a pressure molded fibrous material, to provide cleaning surface 71. When so constructed, if necessary, portions as described hereinafter for attachment to handle portion 21 can be relatively more dense, or can incorporate polymeric materials, paperboard materials, waxes, or other stiffening agents providing a more rigid material in areas involved in connection to handle portion 21. Additionally, all or portions of cleaning head can incorporate chemicals, including for instance cleaning and/or fragrance agents. Cleaning head 70 can also be designed to be flushable after use, and in this regard, if necessary, can be designed to dissolve, disintegrate, unravel or otherwise adopt a new configuration that is better suited for flushing after a suitable period of contact with water in the toilet bowl.

Cleaning head 70 presents a receiving slot 74 for receiving retention members 28 and 29 when rods 24 and 25 are in their deflected configuration. Again, when such deflection is released, retention members 28 and 29 move outwardly relative to one another and are received within receiving apertures 72 and 73 thus establishing a releasable connection between handle portion 21 and cleaning head 70. Cleaning head 70 can include a lateral opening 75 to facilitate the connection/disconnection operation with handle portion 21. Cleaning head 70 also includes internal side walls 76 and 77, which serve to fix cleaning head 70 against rods 24 and 25 so as to prevent or inhibit rotational movement of cleaning head 70 relative to rods 24 and 25. For example, as illustrated, walls 76 and 77 can be curved to match exterior contours of cylindrical rods 24 and 25 to provide a snug fit therebetween. It will be understood in this regard that other configurations of rods 24 and 25 which provide for a snug and secure fit with corresponding walls 76 and 77 of cleaning head 70 are contemplated as within the present invention. As an illustration, rods 24 and 25 may have a polygonal cross section, for example a square cross section, and walls 76 and 77 can have corresponding polygonal cross-sections which partially or completely extend around the circumference of rods 24 and 25. Cleaning head 70 can if desired incorporate cleaning or other agents 78 for release during the cleaning operation.

Components of the cleaning devices of the invention can be formed from any suitable materials such as plastic, metal, or paper products. Preferably, rods 24 and 25 as discussed herein are made of a suitable rust-resistant metal, for example stainless steel.

It will be understood that the handle portion 21 described herein may be attachable and used with other end implements, including for example both disposable and non-disposable implements. Illustratively, handle portion 21 can be used with attachable plunger elements, or other elements used in cleaning or servicing operations for toilet bowls or similar areas.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. In addition, all publications cited herein are indicative of the abilities of those of ordinary skill in the art and are hereby incorporated by reference in their entirety as if individually

What is claimed is:

1. A sanitary cleaning device, comprising:

(i) a handle portion having a grip and two elongate rods, the elongate rods each terminating in an integrally connected retention member which is a generally straight member extending transversely to a longitudinal axis of the rod to which the retention member is integrally connected, each retention member having a substantially circular, transverse cross-section, and the elongate rods each having a lower rod segment occurring between the retention member and the grip and presenting external rod surfaces adjacent the retention member; the handle portion having an upper region sized to remain external of a toilet during a cleaning operation; said upper region including said grip, said handle portion further including a lower region to be received within a toilet during a cleaning operation, said lower region including the retention members and the lower rods segments, and said lower region being free from any wedge piece between the two elongate rods that holds the two elongate rods in a position spaced from one another; further wherein the elongate rods extend from the grip and have a relaxed condition in which the rods are spaced from one another and do not cross one another as they extend from the grip to the retention members;

(ii) a disposable cleaning head comprising:

(a) a cleaning surface for contact with toilet surfaces;

(b) cooperating substantially circular apertures for cooperating with the retention members of the elongate rods to provide selective attachment and detachment between the cleaning head and the handle portion, said attachment occurring upon movement of the elongate rods away from one another toward said relaxed condition so as to position the retention members within the apertures and said detachment occurring upon deflection of said rods toward one another, the cleaning head including an end receiving slot cooperating with a lateral opening for assisting coupling of the retention members with the apertures;

(c) walls adjacent to said cooperating apertures, said walls contoured to match and extend partially around a circumference of each of said external rod surfaces and positioned to receive said external rod surfaces thereagainst when said cleaning head is attached to said handle portion with the retention members in said openings so as to inhibit rotational movement of the cleaning head relative to the elongate rods and provide for a non-rotatable attachment of said cleaning head to said handle portion, said walls extending along and defining said lateral opening;

(d) said cleaning head dimensioned for cleaning a toilet and having a bulbous scrubbing surface; and (e) wherein said rods are deflectable toward one another by compression of said rods by a user's hand in said upper region upon or proximate to said grip, so as to thereby enable said attachment and detachment of said cleaning head by the user without touching said lower region of said handle portion.

2. The sanitary cleaning device of claim 1, wherein said elongate rods are made of metal.

3. The sanitary cleaning device of claim 2, wherein the metal is stainless steel.

4. The sanitary cleaning device of claim 1, wherein said disposable cleaning head comprises a cleaning agent.

5. The sanitary cleaning device of claim 4, wherein the cleaning agent is incorporated within the disposable cleaning head.

6. The sanitary cleaning device of claim 1, wherein said cleaning surface comprises bristles.

7. The sanitary cleaning device of claim 1, wherein:

said two elongate rods extend from the grip.

8. The sanitary cleaning device of claim 7, wherein said rods are made of metal.

9. The sanitary cleaning device of claim 8, wherein said retention members comprise prongs.

10. The sanitary cleaning device of claim 1, wherein said disposable cleaning head comprises a rigid base and wherein said cleaning surface is attached to the rigid base.

11. The sanitary cleaning device of claim 10, wherein the rigid base defines said cooperating apertures.

12. The sanitary cleaning device of claim 1, wherein said disposable cleaning head comprises a disposable sponge or paper material.

13. The sanitary cleaning device of claim 1, wherein said cleaning surface is provided by a disposable sponge or paper material.

14. A sanitary cleaning device, comprising:

(i) a handle portion including:

an upper handle region sized to remain external of a toilet during a cleaning operation with said device, and a lower handle region to be received within the toilet during the cleaning operation;

a first elongate rod terminating in a first, generally straight prong having a substantially circular, transverse cross-section, the first prong extending in a first direction transverse to a longitudinal axis of the first elongate rod, said first elongate rod also presenting first external rod surfaces adjacent the first prong and extending toward the upper handle region;

a second elongate rod terminating in a second, generally straight prong having a substantially circular, transverse cross-section, the second prong extending in a second direction transverse to a longitudinal axis of the second elongate rod, said second direction generally opposite to that of said first direction, said second elongate rod presenting second external rod surfaces adjacent the second prong and extending toward the upper handle region;

said lower handle region consisting of lower portions of said first and second elongate rods;

a grip portion, said first and second elongate rods extending from said grip portion;

said grip portion occurring in said upper region of said handle, and said first and second prongs and said first and second external rod surfaces occurring in said lower region of said handle;

said first and second elongate rods having a relaxed condition in which the first and second elongate rods are spaced from one another and do not cross one another as they extend from the grip portion to the first and second prongs;

said first prong and said second prong spaced from one another a first distance when said first and second elongate rods are in a relaxed condition;

said first and second elongate rods being temporarily deflectable toward one another upon application of a deflection force in said upper region of said handle upon or proximate to said grip portion so as to move said first prong and second prong to be spaced from one another a second distance, said second distance being less than said first distance;

(ii) a cleaning head for cleaning a toilet, the cleaning head including:

a cleaning surface for contact with toilet surfaces;

a receiving slot cooperating with a lateral opening for assisting coupling of the prongs with the cleaning head, the receiving slot sized to allow passage of said first prong and said second prong when they are spaced from one another at said second distance upon application of said deflection force;

a first aperture having a substantially circular, transverse cross section, the first aperture extending in a first aperture direction from said receiving slot, and a second aperture having a substantially circular, transverse cross section, the second aperture extending in a second aperture direction from said receiving slot, said first aperture direction generally opposite said second aperture direction, said first prong alignable with said first aperture and said second prong alignable with said second aperture when said first and second prongs are spaced from one another said second distance upon application of said deflection force;

said receiving slot defining a first slot wall contoured to match and extend partially around a circumference of said first external wall surfaces of said first rod, said receiving slot also defining a second slot wall opposite said first wall and contoured to match and extend partially around a circumference of said second external wall surfaces of said second rod, said walls extending along and defining said lateral opening;

said first slot wall and second slot wall configured to receive said first and second external rod surfaces thereagainst upon release of said deflection force and movement of said first and second elongate rods away from one another, so as to inhibit rotational movement of the cleaning head relative to the elongate rods and provide for a non-rotatable attachment of said cleaning head to said handle portion; and said first and second apertures configured to receive said first and second prongs upon release of said deflection force and movement of said first and second elongate rods away from one another, so as to attach said cleaning head to said handle portion.

15. The sanitary cleaning device of claim 14, wherein said cleaning head comprises a rigid base and wherein the cleaning surface is attached to the rigid base.

16. The sanitary cleaning device of claim 15, wherein the rigid base defines said slot and said first and second apertures.

17. A toilet servicing device, comprising:

(i) a handle portion including:

an upper handle region sized to remain external of a toilet during a servicing operation with said device, and a lower handle region to be received within the toilet during the servicing operation;

a first elongate rod including an upper first rod region occurring within said upper handle region, and a lower first rod region occurring within said lower handle region, the lower first rod region presenting a first generally straight prong having a substantially circular, transverse cross-section, the first prong extending in a first direction transverse to a longitudinal axis of the first elongate rod and providing a terminal end of the first elongate rod, said lower first rod region also presenting first external rod surfaces adjacent the first prong and extending toward the upper handle region;

a second elongate rod including an upper second rod region occurring within said upper handle region, and a lower second rod region occurring within said lower handle region, the lower second rod region presenting a second generally straight prong having a substantially circular, transverse cross-section, the second prong extending in a second direction transverse to a longitudinal axis of the second elongate rod and providing a terminal end of the first elongate rod, said lower second rod region also presenting second external rod surfaces adjacent the second prong and extending toward the upper handle region;

said lower handle region of said device consisting of said lower first rod region and said lower second rod region;

a grip portion, said upper second rod region and said upper first rod region extending from said grip portion;

said first and second elongate rods having a relaxed condition in which the first and second elongate rods are spaced from one another and do not cross one another as they extend from the grip portion to the first and second prongs;

said first prong and said second prong spaced from one another a first distance when said first and second elongate rods are in a relaxed condition;

said first and second elongate rods being temporarily deflectable toward one another upon application of a deflection force in said upper region of said handle upon or proximate to said grip portion so as to move said first prong and second prong to be spaced from one another a second distance, said second distance being less than said first distance;

(ii) a servicing implement for servicing a toilet, the servicing implement including:

a receiving slot cooperating with a lateral opening for assisting coupling of the prongs with the servicing implement, the receiving slot sized to allow passage of said first prong and said second prong when they are spaced from one another at said second distance upon application of said deflection force;

a first aperture having a substantially circular, transverse cross section, the first aperture extending in a first aperture direction from said receiving slot, and a second aperture having a substantially circular, transverse cross section, the second aperture extending in a second aperture direction from said receiving slot, said first aperture direction generally opposite said second aperture direction, said first prong alignable with said first aperture and said second prong alignable with said second aperture when said first and second prongs are spaced from one another said second distance upon application of said deflection force;

said receiving slot defining a first slot wall contoured to match and extend partially around a circumference of said first external wall surfaces of said first rod, said receiving slot also defining a second slot wall opposite said first wall and contoured to match and extend partially around a circumference of said second external wall surfaces of said second rod, said walls extending along and defining said lateral opening;

said first slot wall and second slot wall configured to receive said first and second external rod surfaces thereagainst upon release of said deflection force and movement of said first and second elongate rods away from one another, so as to inhibit rotational movement of the servicing implement relative to the elongate rods and provide for a non-rotatable attachment of said servicing implement to said handle portion; and said first and second apertures configured to receive said first and second prongs upon release of said deflection force and movement of said first and second elongate rods away from one another, so as to attach said servicing implement to said handle portion.

18. The toilet servicing device of claim 17, wherein said servicing implement is a cleaning head.

* * * * *